US005953950A

United States Patent [19]

Sasaoka et al.

[11] Patent Number: 5,953,950

[45] Date of Patent: Sep. 21, 1999

[54] METHOD AND APPARATUS FOR MANUFACTURING DISK PRODUCTS HAVING HELICAL RIDGES

[75] Inventors: Shinkichi Sasaoka; Yoshinori Yama; Fujio Sakatani; Shouichi Tsuruga, all of Osaka, Japan

[73] Assignee: Japan, represented by Director-General, Mint Bureau, Ministry of Finance, Osaka, Japan

[21] Appl. No.: 09/082,727

[22] Filed: May 21, 1998

[30] Foreign Application Priority Data

May 23, 1997 [JP] Japan ..... 9-133987

[51] Int. Cl.[6] ..... B21D 45/04

[52] U.S. Cl. ..... 72/344; 72/345; 72/355.6; 72/359

[58] Field of Search ..... 72/344, 345, 355.6, 72/359; 29/893.34

[56] References Cited

U.S. PATENT DOCUMENTS

| | | | |
|---|---|---|---|
| 1,965,670 | 7/1934 | Schauer | 78/13 |
| 3,599,469 | 8/1971 | Bassoff | 72/343 |
| 3,605,475 | 9/1971 | Eakin et al. | 72/256 |
| 3,910,091 | 10/1975 | Samanta | 72/256 |
| 3,910,096 | 10/1975 | Debus | 72/344 |
| 4,044,592 | 8/1977 | Carrieri et al. | 72/462 |
| 4,351,177 | 9/1982 | Leykamm et al. | 72/354 |
| 4,918,970 | 4/1990 | Ishinaga | 72/354 |
| 4,924,690 | 5/1990 | Kanamaru et al. | 72/343 |
| 5,275,046 | 1/1994 | Nagpal et al. | 72/467 |
| 5,295,382 | 3/1994 | Furhmann | 72/343 |

FOREIGN PATENT DOCUMENTS

| | | |
|---|---|---|
| 3-238140 | 10/1991 | Japan . |
| 1 342 275 | 4/1971 | United Kingdom . |

*Primary Examiner*—Joseph J. Hail, III
*Assistant Examiner*—William Hong
*Attorney, Agent, or Firm*—Wenderoth, Lind & Ponack, L.L.P.

[57] ABSTRACT

A method and an apparatus for producing a disc product having a plane carrying a relief and helical ridges on the outer peripheral side. The inventive production method and the apparatus therefor have enabled a continuous processing of a material mass to forge into, produce and push out a disc product while retaining the quality of the relief plane, and thereby facilitating production of the disc product by die forging.

11 Claims, 3 Drawing Sheets

METHOD AND APPARATUS FOR MANUFACTURING DISK PRODUCTS HAVING HELICAL RIDGES

FIELD OF THE INVENTION

The present invention relates to a method and an apparatus for producing disc products such as medals and coins. More particularly, the present invention relates to a method and an apparatus for producing medals and coins having a relief on a disc plane and helical ridges on the outer peripheral side thereof.

BACKGROUND OF THE INVENTION

Medals and coins (hereinafter representatively referred to simply as coins) sometimes have ridges as shown in FIG. 3 on the outer peripheral side thereof. The ridges are formed with the aim of decoration and differentiation from other coins.

For example, in the typical ridges found in 100 yen coins distributed as of 1997 in Japan, the direction of the ridge line ml of respective convex parts (hereinafter ridges) is, as shown in a simplified manner in FIG. 3(*a*), identical with the direction of rotation axis Y of a disc product, and so is the line of the notched bottom of the milled edge.

One example of ridges is a helical one. In this embodiment, the ridge line m2 forms an angle with the direction of rotation axis Y of a disc product, as shown in FIG. 3(*b*). The helical ridges have decorative functions and enable easy identification of a product due to the characteristic appearance.

As mentioned above, typical ridges have a ridge line that coincides in direction with the rotation axis of a coin, so that a single die may be used to forge both the relief plane and the ridges on the outer peripheral side. Then, the end product may be easily pushed out (knocked out) from the die with a punch that pushes the coin in the direction of the rotation axis. Thus, a coin having typical ridges permits use of a simple die and can be produced in large numbers at low costs.

In a coin having helical ridges, in contrast, the direction of the ridge differs from that of the rotation axis of the coin. Thus, pushing out by a simple movement of a punch as achieved with disc products with typical ridges is difficult to achieve. This constitutes a first obstacle.

What is more, a coin having helical ridges experiences difficulty in pushing out caused by a relief peculiar to coins. That is, a relief comprising letters and drawings depicted on the disc plane of the coin should be free of scars and nicks, and the coin should be pushed out without impairing the good appearance of this plane. For this end, the relief plane of the coin in a collar should be kept in continued close contact with the relief die on the punch. In this way, the friction between the relief plane and the relief die can be avoided during the time period from forging of the relief plane of the coin to pushing out thereof. Therefore, the movement of the coin in the collar during pushing out is limited in orders to maintain the quality of the relief. While the existence of a relief does not become an obstacle with respect to the pushing out for typical ridges, it constitutes a second obstacle for the pushing out of a coin having helical ridges.

When a coin having helical ridges is produced as mentioned above, it is difficult to forge and produce a coin having helical ridges and a relief in a single process from a material mass using a die having a simple structure. Thus, helical ridges have been formed in a different step such as rolling.

It is therefore an object of the present invention to provide a method for producing a disc product having a plane with a relief and helical ridges on the outer peripheral side, easily by die forging.

It is another object to provide, as a production apparatus, a forging die having a simple structure for the production of such a disc product.

SUMMARY OF THE INVENTION

The method of the present invention aims at producing disc products having a plane carrying a relief and helical ridges on the outer peripheral side, and comprises the following steps:

(1) rotatably retaining, in a forging die apparatus, an annular tool about a rotation axis thereof and forming notches to provide a helical milling die on an inner peripheral wall of a center hole of the annular tool, (2) sandwiching, in the center hole of the annular tool, a material between a pair of punches having an imprinting surface on at least one of the punches and applying a pressure for die forging to shape a product, and (3) transporting the product by pushing it with one of the punches in the axis direction of the punch while keeping the product in close contact with the imprinting surface of the punch, and pushing out the product while rotating the annular tool simultaneously therewith.

The apparatus of the present invention is used for producing a disc product. The product has a plane with a relief and helical ridges on an outer peripheral side. The apparatus comprises a forging die, an annular tool and a pair of punches. The annular tool is retained in the forging die, such that it can rotate about the rotation axis. This annular tool has notches on an inner peripheral wall of a center hole thereof to give a helical milling die. The punches have an imprinting surface on at least one of the punches. The pair of punches can sandwich a material and apply a pressure for die forging to shape a product in the center hole of the annular tool. The punches can transport the product, after completion of the forging, by pushing the product in the axis direction of the punch. Concurrently therewith, the annular tool rotates so as not to hinder the transport of the product.

The disc product to be manufactured by the production method and production apparatus of the present invention is exemplified by medals and coins having a relief on, for example, both surfaces thereof.

DETAILED DESCRIPTION OF THE INVENTION

The structure of the inventive apparatus and the production method are described in the following by referring to a coin as an exemplary product.

Figure 1:
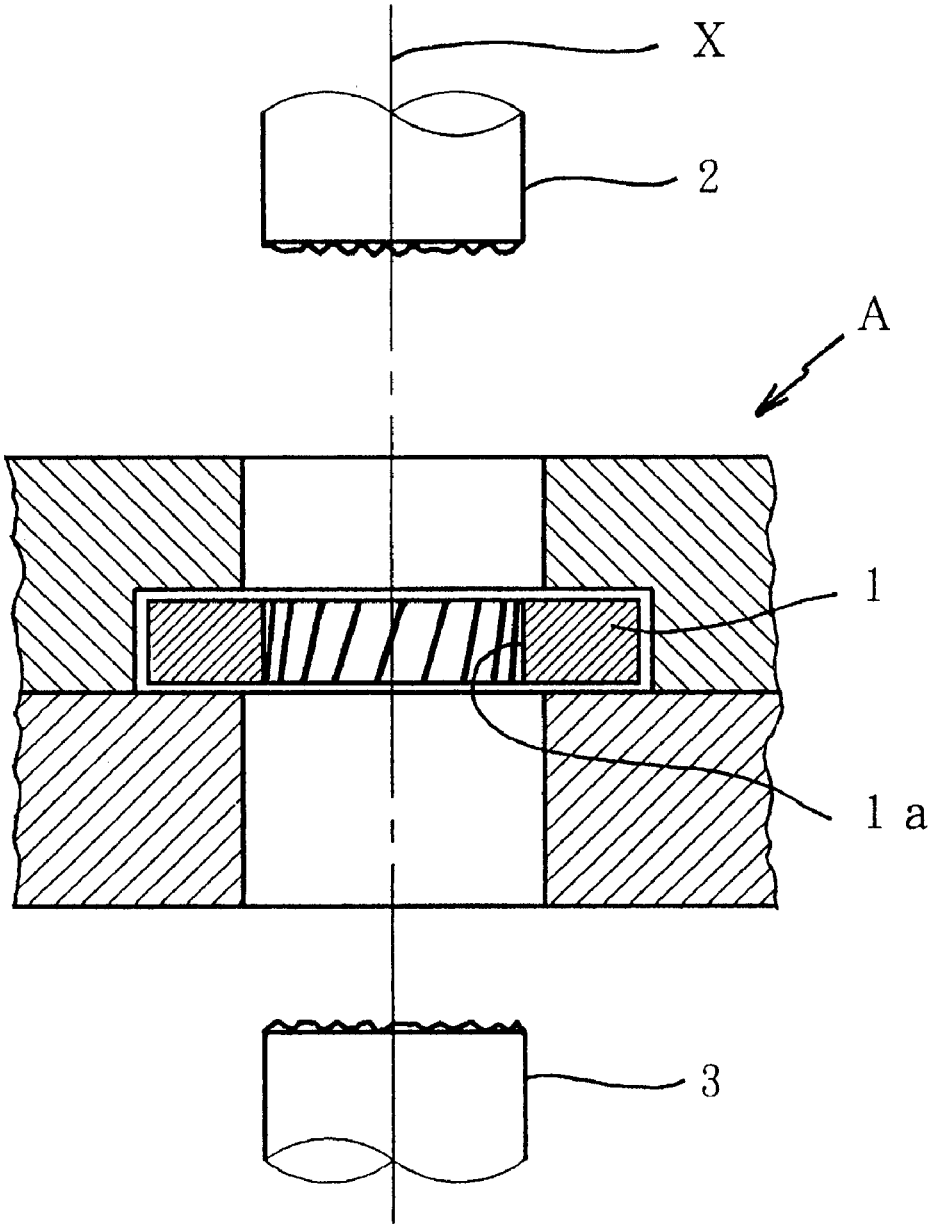
FIG. 1 is a schematic cross sectional view showing one embodiment of the inventive apparatus. In this figure, a pair of punches have been extracted from the die for better understanding of the structure.

As shown in FIG. 1, an annular tool 1 is retained in a forging die apparatus A in a rotatable manner in the direction circling a ring about the rotation axis X. In FIG. 1, a structure to make the rotation smooth, such as a bearing, is omitted. The center hole of the annular tool 1 determines the outer shape of the coin. The inner wall 1*a* of the center hole has notches to constitute a helical milling die. A pair of opposing upper and lower punches 2 and 3 are inserted into this center hole, where the punches hold a material mass and pressure the material in between the punches to effect forging of the both relief surfaces and helical ridges. The rotation axis X of the annular tool, rotation axis of the forged coin and the center axis of the upper and lower punches are synchronized or aligned and hereinafter to be referred to simply as an "axis".

This die structure permits pushing out of a coin from a forging die while keeping the relief plane of the coin in close contact with the relief die plane of the punch. For example, in FIG. 1, the upper punch 2 is removed from a product and retracted from the die, and the product is pushed by the lower punch 3 in the axial direction while keeping the product in close contact with the lower punch 3. In so doing, the helical milling die of the annular tool 1 rotates without interfering with the movement of the helical ridges of the product.

When pushed out, therefore, the relief surface of a coin does not cause friction with the relief die plane of the punch and can be moved toward the axis direction of the coin (direction different from the direction of the ridges). In other words, the two obstacles experienced in the production of a helically ridged coin, which have been discussed under Background of the Invention above, can be overcome by the die having a simple structure.

The stroke action of the both punches may be that employed in the production of other typical coins. For example, the starting position of the lower punch, i.e. the lower limit, is set in the center hole of the die. The starting position of the upper punch, i.e. the upper limit, is set outside of the die. In this way, feeding and retention of the material mass can be facilitated. When pushing out, by stroking the lower punch upward toward the outside of the die, the coin can be removed from the upper side of the die.

The coin after forging may be pushed out in either direction of the punch and the direction is determined by the structure of the press. It is essential, however, that the coin should not be released from the punch on the pushing side.

When the coin is pushed out, the punch that is not involved in the pushing out retracts first or retracts together with the punch on the pushing side while sandwiching the coin, which is optionally determined in consideration of the axial direction of the punch and structure of the die.

In FIG. 1, the axial direction of the punch and the direction of movement are upward and downward, which may be any depending on the structure and operation mechanism of the press.

Figure 2:
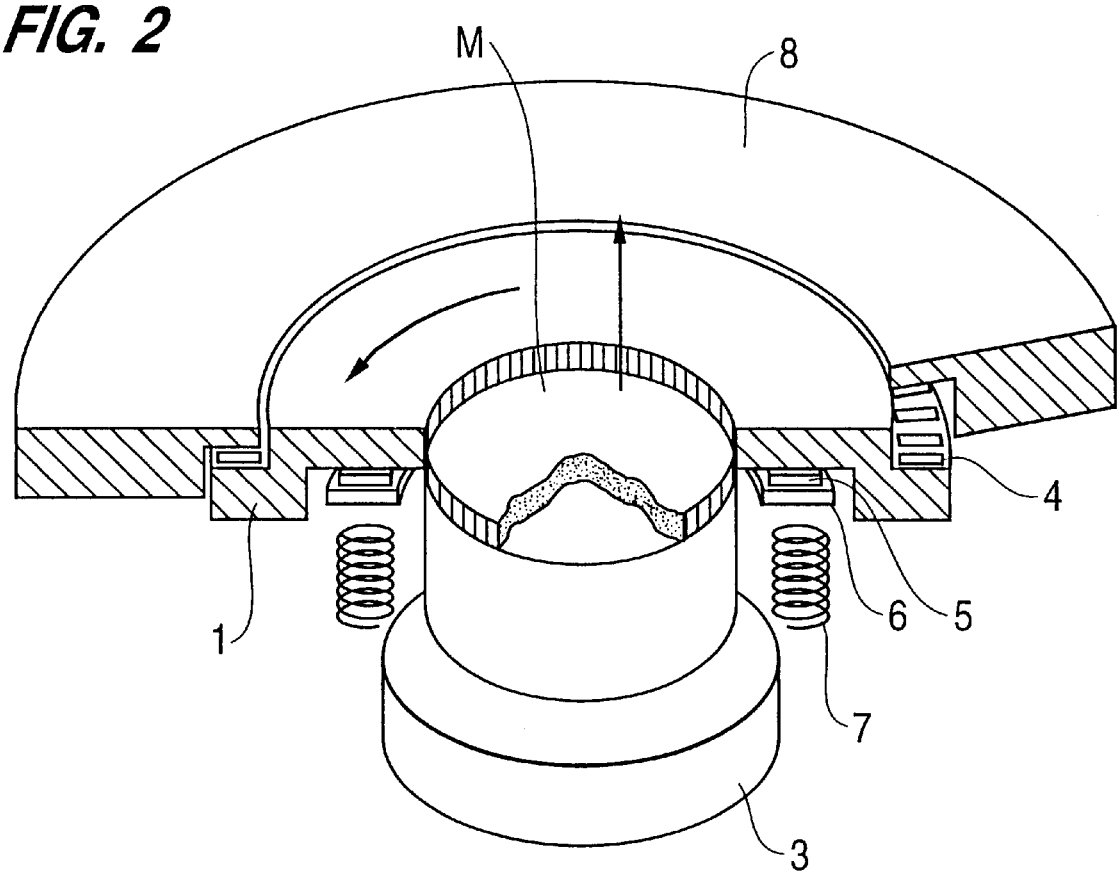
FIG. 2 is a schematic cross sectional view of the inventive apparatus produced in an example of the present invention wherein like reference symbols as in FIG. 1 are used for like parts. In this figure, a medal M is being push out, wherein the medal is moving toward the direction shown by a thick arrow (upward) by the action of a lower punch 3. An upper punch receded out from the view and is not shown.

The annular tool rotates in the direction of showing in FIG. 2, in such a manner that the helical milling die does not hinder the movement of helical ridges of the product during pushing out or removal operation. The annular tool may rotate following the positional variations of the helical ridges that are caused by a force produced by the helical ridges of the coin. Alternatively, the annular tool may be actively rotated by an outside force in harmony with the movement of the coin in the axis direction and positional variations of the helical ridges. Of these, the former is preferable in that the structure of the die can be simplified.

When the force produced by the helical ridges rotates the annular tool, the annular tool should be retained in the die apparatus in such a manner that a small force produced by the notches or ridges of a coin is sufficient to cause smooth rotation. The annular tool may be retained in a rotatable manner by the use of a thrust bearing shown in FIG. 2. As long as the annular tool is free of a strong force in the axial direction, a radial bearing may be set on the outer periphery of the annular tool. Alternatively, a rolling bearing and other known bearing means may be combined in any manner. The tool may be retained using a lubricant, without using a bearing.

The relation of the standard inner diameter of the center hole of the annular tool and the outer diameter of the punch may be that known with respect to the die technique used for typical ridges.

Figure 3:
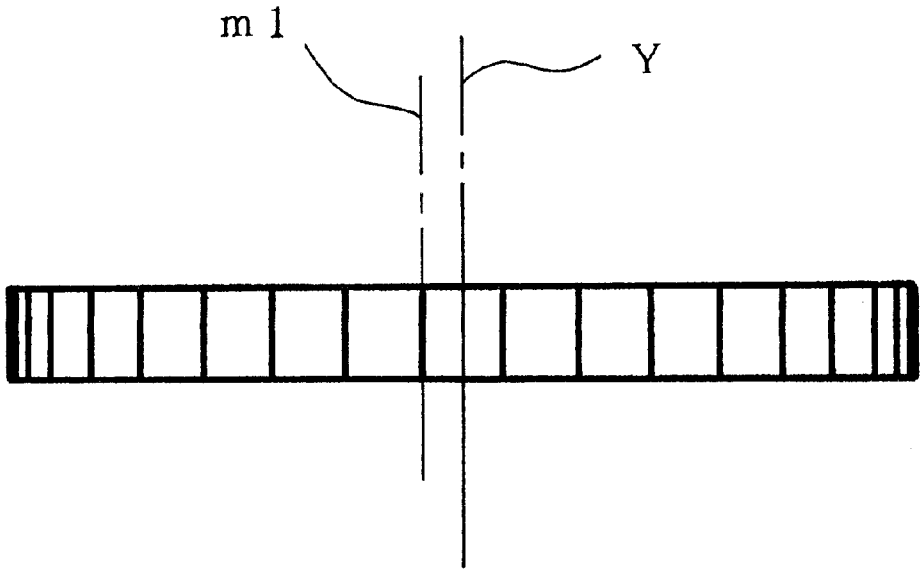
FIG. 3 shows ridges to be formed on the coin.
Figure 3:
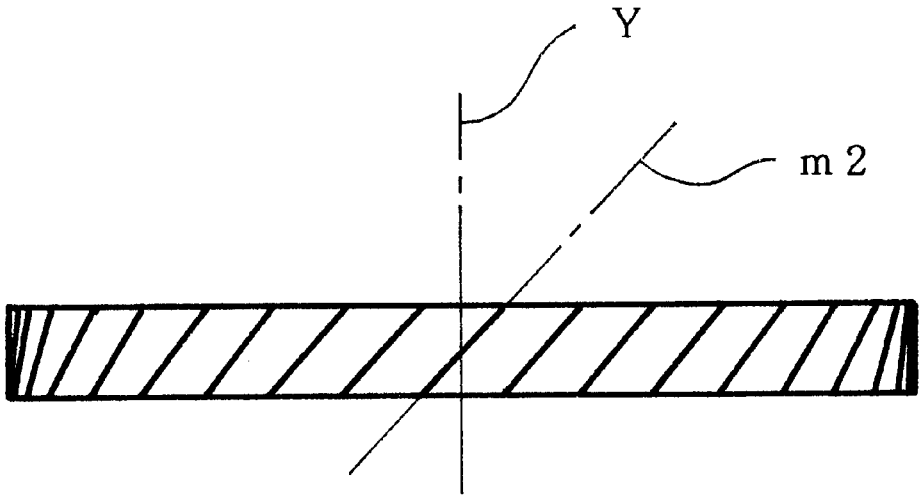

In the present invention, the angle formed by a ridge line m2 as shown in FIG. 3(*b*) and the rotation axis Y is not limited. It may be about 1°–45° and preferably about 5°–20° from a technical viewpoint and for better appearance, and most preferably 10° as employed in the following example.

The inventive production apparatus was prepared and the production method of the present invention was practiced using this apparatus as in the following.

In this example, medals having reliefs on both sides and helical ridges on the outer peripheral side formed an angle of 10° with respect to the rotation axis, and were prepared using various materials.

The medals had an outer diameter of about 30 mm and a thickness of about 2 mm, and were made from gold, silver, copper, aluminum and copper alloy.

As shown in FIG. 2, an annular tool 1 is supported from above and below by thrust bearings 4 and 5 and can be smoothly rotated in the forging die apparatus. In this example, a needle bearing was used as a thrust bearing. The annular tool 1 had a center hole having notches on its inner wall to give a helical milling die. The annular tool 1 and the thrust bearings 4 and 5 from above and below are thrust against an upper insert member 8 by a spring 7 and a washer 6, with a suitable pressure so that smooth rotation, which is free of rattling, can be secured.

The insert member 8 is a part of the forging die apparatus. It is detachably set to the main body of the forging die apparatus so that the apparatus comprising an annular tool can be conveniently assembled and disassembled.

The annular tool as shown in FIG. 2 is not of a simple donut shape as shown in FIG. 1. It has a tiered structure having a brim projecting outward like a derby hat, wherein the top surface of the annular tool and the top surface of the insert member 8 are on the same plane.

Using the forging die apparatus shown in FIG. 2, medals were made from the above-mentioned six kinds of materials. The annular tool 1 rotated smoothly by the force produced by the helical ridges of the medal M, along with the upward movement of the medal M in the axial direction due to the action of the lower side punch 3. In addition, the medal M was pushed out on the top surface of the die in good condition without being released from the lower side punch 3 even in the presence of a resistance from the annular tool 1.

As discussed above, the inventive production method and the apparatus therefor have enabled a continuous processing of a material mass to forge into, produce and push out a disc product. The product includes a coin and a medal having a plane with a relief and helical ridges on the outer peripheral side thereof. During the process, the quality of the relief plane is maintained, thereby facilitating production of disc products by die forging.

This application is based on application No. 133987/1997 filed in Japan, the content of which is incorporated hereinto by reference.

What is claimed is:

1. A method for producing a disc having a generally planar surface carrying a relief and helical ridges formed on an outer peripheral side of the disc, said method comprising:

providing an annular tool in a forging die apparatus, wherein the annular tool has a center hole defined by an inner peripheral surface which has a plurality of notches to provide a milling die, and the annular tool is rotatable about an axis thereof relative to the forging die;

inserting a material in the center hole of the annular tool;

applying pressure to the material by sandwiching the material between a pair of punches in order to form a shaped product, wherein at least one of the punches has an imprinting surface;

pushing the formed product with one of the punches in an axial direction thereof while maintaining the product in close contact with the imprinting surface of the punch; and rotating the annular tool simultaneously as the product is pushed by the punch.

2. The method as claimed in claim 1, wherein the formed disc product is a medal which has reliefs formed on both generally planar surfaces thereof.

3. The method as claimed in claim 1, wherein the formed disc product is a coin which has reliefs formed on both generally planar surfaces thereof.

4. The method as claimed in claim 1, wherein the notches in the inner peripheral surface of the annular tool form helical ridges having an angle of 1 degree to 45 degrees with respect to the rotation axis of the annular tool.

5. The method as claimed in claim 1, wherein the step of rotating the annular tool is achieved by a force which is produced by the helical ridges of the disc product as it is being pushed out by the punch.

6. An apparatus for producing a disc product having a plane with a relief and helical ridges on an outer peripheral surface of the disc product, said apparatus comprising:

a forging die;

an annular tool rotatably supported in said forging die such that said annular tool is rotatable about a rotational axis thereof, said annular tool having an inner peripheral wall defining a central hole, and a plurality of notches formed on the inner peripheral wall so as to provide a helical milling die; and a pair of punches for sandwiching and applying pressure to a material in the center hole of said annular tool in order to form the disc product, wherein said punches are movable along an axial direction thereof, at least one of said punches has an imprinting surface, and said punches are capable of transporting the material, upon completion of forging, by pushing the material in the axial direction, and concurrently rotating the annular tool so as not to hinder movement of the helical ridges formed in the outer peripheral surface of the disc product.

7. The apparatus as claimed in claim 6, wherein the disc product is a medal or a coin having reliefs formed on both surfaces.

8. The apparatus as claimed in claim 6, wherein the notches formed on the inner peripheral wall of said annular tool form an angle of 1°–45° to the direction of the rotation axis of said annular tool.

9. The apparatus as claimed in claim 6, wherein said annular tool is rotatable by a force produced by the helical ridges of the disc product as the disc product is pushed by one of the punches.

10. The apparatus as claimed in claim 6, further comprising a thrust bearing for retaining said annular tool in a rotatable manner in said forging die.

11. The apparatus as claimed in claim 6, wherein said forging die is fixed in position, and the annular tool rotates relative to said forging die.

* * * * *